US006837346B2

(12) United States Patent
Hollingsworth

(10) Patent No.: US 6,837,346 B2
(45) Date of Patent: Jan. 4, 2005

(54) CARRYING CASES WITH POP-OUT COMPARTMENTS

(75) Inventor: W. Dale Hollingsworth, Wilton, CT (US)

(73) Assignee: EZM, Inc., Norwalk, CT (US)

( * ) Notice: Subject to any disclaimer, the term of this patent is extended or adjusted under 35 U.S.C. 154(b) by 0 days.

(21) Appl. No.: 10/305,372

(22) Filed: Nov. 27, 2002

(65) Prior Publication Data

US 2004/0099496 A1 May 27, 2004

(51) Int. Cl.[7] ..... A45C 3/00; A45C 1/02

(52) U.S. Cl. ..... 190/11; 190/109; 150/112; 150/113; 150/117

(58) Field of Search ..... 190/111, 112, 190/901; 150/116, 117, 112, 113; 383/41

(56) References Cited

U.S. PATENT DOCUMENTS

| | | | | | |
|---|---|---|---|---|---|
| 328,588 | A | * | 10/1885 | Jordan | 190/112 |
| 1,495,046 | A | * | 5/1924 | Spiegel | 190/111 |
| 1,514,996 | A | * | 11/1924 | Sitney | 150/117 |
| 1,647,551 | A | * | 11/1927 | St. Lawrence | 190/111 |
| 1,650,672 | A | * | 11/1927 | Walinsky | 190/111 |
| 1,927,624 | A | * | 9/1933 | Appel | 150/117 |
| 2,180,191 | A | * | 11/1939 | Bauch | 190/111 |
| 2,213,821 | A | * | 9/1940 | McCurdy | 190/111 |
| 2,331,428 | A | * | 10/1943 | Selezneff | 150/117 |
| 2,487,220 | A | * | 11/1949 | Callaghan | 206/541 |
| 2,674,288 | A | * | 4/1954 | Laidlaw | 190/115 |
| 2,797,719 | A | * | 7/1957 | Hume | 150/117 |
| 2,937,680 | A | * | 5/1960 | Dumas | 150/116 |
| 2,988,125 | A | * | 6/1961 | Reynolds | 206/316.2 |
| 3,912,055 | A | * | 10/1975 | Malooly | 190/109 |
| 4,483,427 | A | * | 11/1984 | Gerch | 190/11 |
| 4,643,281 | A | * | 2/1987 | Erickson | 190/119 |
| 4,790,417 | A | | 12/1988 | Tomikawa et al. | 190/102 |
| 4,840,258 | A | | 6/1989 | Tomikawa et al. | 190/102 |
| 5,348,347 | A | | 9/1994 | Shink | 281/31 |
| 5,749,447 | A | * | 5/1998 | Hersh et al. | 190/112 |
| 5,961,018 | A | | 10/1999 | Abelbeck et al. | 224/584 |
| 6,047,752 | A | | 4/2000 | Southwick | 150/117 |
| 6,123,127 | A | | 9/2000 | Su | 150/116 |
| 2001/0027834 | A1 | | 10/2001 | Southwick | 150/108 |
| 2001/0039195 | A1 | | 11/2001 | Nickum | 455/557 |

FOREIGN PATENT DOCUMENTS

| | | | | |
|---|---|---|---|---|
| DE | 443428 | * | 6/1932 | 190/111 |
| FR | 2480579 | * | 10/1981 | 190/111 |
| GB | 585845 | * | 2/1947 | 190/111 |
| GB | 2178401 A | * | 2/1987 | B65D/51/00 |
| JP | 231005 | | 8/1992 | |

* cited by examiner

*Primary Examiner*—Sue A. Weaver

(57) ABSTRACT

A carrying case comprises an enclosure including a plurality of external walls and an external panel disposed over a window in one of the external walls communicating with an interior compartment. The enclosure has a selectively openable, selectively closable compartment opening providing access into the interior compartment when the opening is open and which prevents access into the interior compartment when the opening is closed. The panel defines a pop-out compartment adapted to carry an object and has a retracted position wherein the pop-out compartment is disposed within the interior compartment for removal of the object from the enclosure through the compartment opening. The panel is pivotable from the retracted position to an extended position wherein the pop-out compartment is withdrawn from the interior compartment for removal of the object from the enclosure via the pop-out compartment independent of the compartment opening.

24 Claims, 7 Drawing Sheets

CARRYING CASES WITH POP-OUT COMPARTMENTS

BACKGROUND OF THE INVENTION

1. Field of the Invention

The present invention relates generally to carrying cases enclosing an interior compartment accessible via a selectively openable and selectively closable compartment opening and, more particularly, to a carrying case in which an object is removable from and placeable in the interior compartment with the compartment opening closed while also being removable from and placeable in the interior compartment via the compartment opening.

2. Brief Description of the Related Art

Carrying cases have become very popular for use in conveniently storing and transporting various objects such as electronic devices, documents, and other personal and business effects. Conventional carrying cases generally enclose an interior defining an interior compartment accessible via a compartment opening that is selectively opened and closed via a closure of the opening. The interior compartment is adapted to hold various objects, sometimes in an organized or segregated arrangement. Many carrying cases enclose a plurality of interior compartments, each of which may be provided with its own selectively openable, selectively closable compartment opening having a closure. Some of the benefits provided by carrying cases include protecting the objects being carried, stabilizing the objects during transport and/or allowing the objects to be organized or segregated within the interior. When using conventional carrying cases, a particular object or objects carried by the carrying cases may necessarily or desirably be removed from and placed in an interior compartment with relatively great frequency. Objects which may be carried by carrying cases and which may be removed from and placed therein with relatively great frequency may be considered frequently accessed objects and may include, for example, electronic devices such as cellular phones, PDAs, personal diaries, pagers, and hand-held computers. It is often inconvenient for a user to remove a frequently accessed object from and/or to place a frequently accessed object in an interior compartment of conventional carrying cases via the compartment opening. For example, the closure of the compartment opening may be relatively difficult or inconvenient to operate; a frequently accessed object in the interior compartment may be difficult to access via the compartment opening due to its location in the interior compartment and/or the presence of other objects in the interior compartment; the carrying case may assume a considerably larger profile in an open position with the compartment opening open than in a closed position with the compartment opening closed so as to require considerable surrounding space to access the interior compartment via the compartment opening; and/or the carrying case may need to be supported or placed on a support surface in the open position.

In order to allow frequently accessed objects to be removed from and placed in a carrying case without operating the closure of a compartment opening, many conventional carrying cases have been designed with external pockets for receiving frequently accessed objects as represented by U.S. Pat. No. 6,047,752 to Southwick and No. 5,961,018 to Abeldeck et al, and by U.S. Patent Application Publications No. US2001/0039195 A1 to Mitham and No. US2001/0027834 A1 to Southwick. Although frequently accessed objects can be removed from and placed in external pockets without opening a compartment opening of the carrying cases, carrying cases having external pockets have numerous disadvantages. The external pockets are ordinarily not in communication with an interior compartment of the carrying cases such that frequently accessed objects in the external pockets cannot also be removed through the interior compartment when the corresponding compartment opening is open. In addition, frequently accessed objects may inadvertently fall out of the external pockets and be lost and/or damaged, especially when the carrying cases are dropped, tipped over, toppled or turned upside down. The pockets afford little structural protection for the objects against damage due to shocks and other impacts, even while the external location of the pockets places the objects therein at increased risk of damage from impacts. A further disadvantage associated with carrying cases having external pockets is that the objects within the pockets are usually at least partially visible from exteriorly of the carrying cases. Where the objects are perceived to be valuable, as may be the case for many electronic devices, the objects are at increased risk of theft, especially since the objects are usually quickly and easily removable from the pockets. Exposure of the objects from the external pockets, the external location of the external pockets and/or the minimal protection provided by the external pockets place the objects at greater risk of damage from external conditions such as heat, cold, fluids and chemicals to which the carrying case may be exposed. Since the objects cannot be removed from and placed in the external pockets via an interior compartment when the corresponding compartment opening is open, versatility, convenience and ease of use are greatly limited.

Some carrying cases are designed with an interior compartment for accommodating a frequently accessed object, with the interior compartment being independently accessible from exteriorly of the carrying case to permit the frequently accessed object to be removed from and placed in the interior compartment independently of a compartment opening as represented by U.S. Pat. No. 6,123,127 to Su and U.S. Pat. Nos. 4,840,258 and 4,790,417 to Tomikawa et al and by Chinese Patent No. 231005. The Su patent relates to a carrying bag having a casing pivotally mounted thereto and receiving a cellular phone. The casing is pivotal out of and into an interior compartment of the carrying bag to permit the cellular phone to be removed from and placed in the interior compartment without opening the compartment opening. When the compartment opening is opened, however, the cellular phone cannot be removed from and placed in the interior compartment through the compartment opening. Also, the cellular phone is free to move within the casing as the casing is pivoted out of and into the carrying bag, thereby subjecting the cellular phone to potential damage. The Tomikawa et al and the Chinese patents disclose carrying cases having a hinged cover divided into primary and secondary cover sections that are independently openable and closable to provide access to primary and secondary interior compartments, respectively. A phone disposed in the secondary interior compartment may be removed from and placed in the carrying case by opening the secondary cover section independently of the primary cover section but the phone is not also removable from the carrying case via the primary interior compartment when only the primary cover section is open. The Tomikawa et al patents also disclose a carrying case characterized by a cover or lid having an opening communicating with a phone disposed in the interior of the carrying case and a bellows-sided panel overlying the cover. The panel forms an external compartment over the cover which is opened via a catch assembly to access the phone through the opening in the cover. Unless the external compartment is intended to hold objects, it represents wasted space that undesirably adds to the cost of materials and fabrication for the carrying case. Where the external compartment is used to contain objects, however, the objects in the compartment are not separated in any way from the phone and may undesirably contact the phone with resulting damage to the phone and/or the objects. In addition, objects in the external compartment may obstruct the opening in the cover and may need to be displaced within or removed from the external compartment to permit access to the phone. In order to remove the phone from and place the phone in the interior, the user must manually insert a hand through the opening in a cumbersome series of movements.

In view of the above, there is a need for a carrying case in which one or more objects is/are conveniently removable from and placeable in an interior compartment of the carrying case from exteriorly thereof without opening a compartment opening into the interior compartment and are also removable from and placeable in the interior compartment through the compartment opening when the compartment opening is open. The need also exists for a carrying case having an external panel defining a pop-out compartment for receiving an object and being withdrawable from an interior compartment of the carrying case in response to pivotal movement of the external panel, the pop-out compartment also being accessible via a compartment opening into the interior compartment to permit removal of the object from and placement of the object in the pop-out compartment through the compartment opening. A need further exists for a carrying case having a pop-out compartment for receiving an object and being selectively withdrawable from and retractable in an interior compartment of the carrying case for removal of the object from and placement of the object in the interior while also stabilizing the object in the pop-out compartment during withdrawal and retraction of the pop-out compartment. There is also a need for a carrying case having a pop-out compartment for receiving an object and being selectively withdrawable from and retractable in an interior compartment of the carrying case for removal of the object from and placement of the object in the interior compartment wherein the object is also protected from other objects in the interior compartment.

SUMMARY OF THE INVENTION

Accordingly, a primary object of the present invention is to overcome the aforementioned disadvantages of prior carrying cases.

Another object of the present invention is to permit an object to be conveniently removed from and placed in an interior compartment of a carrying case from exteriorly of the carrying case without opening a compartment opening into the interior compartment and while also allowing the object to be removed from and placed in the interior compartment through the compartment opening when the compartment opening is open.

A further object of the present invention is to move an object through an opening in an external wall of a carrying case in response to movement of an external panel mounted on the external wall to effect the object being removed from or placed in the interior of the carrying case.

An additional object of the present invention is to isolate and stabilize an object on an external panel used to move the object through an opening in an external wall of a carrying case for removal of the object from or placement of the object in the interior of the carrying case.

It is also an object of the present invention to permit a pop-out compartment of a carrying case to be selectively retracted in and withdrawn from an interior compartment of the carrying case independently of a compartment opening into the interior compartment so that an object carried by the pop-out compartment can be inserted in and withdrawn from the interior compartment independently of the compartment opening while also being insertable in and withdrawable from the interior compartment through the compartment opening.

The present invention has as another object to conceal an object within an interior compartment of a carrying case so that the object cannot be seen from exteriorly of the carrying case while allowing the object to be removed from and placed in the interior compartment without opening a compartment opening into the interior compartment as well as through the compartment opening when the compartment opening is open.

Yet a further object of the present invention is to pivot an external panel of a carrying case away from an external wall of the carrying case such that an object secured on the external panel is moved through an opening in the external wall for disposition externally of the external wall.

Still another object of the present invention is to pivot an external panel of a carrying case toward an external wall of the carrying case such that an object secured on the external panel is moved through an opening in the external wall for disposition in the interior of the carrying case.

Moreover, it is an object of the present invention to protect an object disposed in a pop-out compartment of a carrying case so that, when the pop-out compartment is disposed in the interior of the carrying case, the object is protected from contact with other objects in the interior.

Some of the advantages of the present invention are that one or more objects may be stabilized and held in place and/or protected on the external panel when the one or more objects are disposed in the interior as well as when the external panel is pivoted to move the one or more objects through the opening in the external wall; the one or more objects may be removed from and/or placed in the interior via the external panel without disturbing other contents of the carrying case; the one or more objects disposed in the pop-out compartment defined by the external panel may be frequently accessed objects such that removal of one or more frequently accessed objects from and placement of one or more frequently accessed objects in the interior is made more convenient; only a small amount of exterior space is needed to accommodate movement of the external panel away from the external wall; the one or more objects can be removed from or placed in the interior via the external panel with the carrying case disposed in various orientations; the one or more objects are removably secured on the external panel in a manner facilitating their removal from and placement in the pop-out compartment; various structure can be used on the external panel to removably secure, stabilize and/or protect the one or more objects; the one or more objects in the pop-out compartment are isolated or separated from other contents of the carrying case during retraction and withdrawal of the pop-out compartment; the external panel may be designed with a self-closing effect to retract the pop-out compartment and close the opening in the external wall when the external panel is not moved outwardly away from the external wall with manual force; the carrying case provides convenience and versatility by allowing one or more objects, and particularly one or more frequently accessed objects, to be removed from and placed in the interior in alternative ways; one or more objects can be removed from and placed in the carrying case while the carrying case maintains a relatively small profile in a closed position; one or more objects can be removed from and placed in the interior of the carrying case in tight confines or spaces too small to conveniently accommodate the configuration of the carrying case in an open position; the one or more objects in the pop-out compartment may be protected or shielded in the interior and are prevented from displacement in the interior when the pop-out compartment is retracted; the pop-out compartment may be open or closed along its interior side; various structures may be provided for maintaining the depth of the pop-out compartment; the one or more objects in the pop-out compartment are prevented from falling out of the carrying case; theft of one or more objects in the pop-out compartment is deterred since the one or more objects are not visible when the pop-out compartment is retracted; the one or more objects may comprise various frequently accessed objects including electronic devices such as cellular phones, PDAs, personal diaries, pagers and hand-held computers; the interior of the carrying case may comprise one or more internal compartments; the pop-out compartment may be no larger than necessary to accommodate the one or more objects to maximize the remaining interior space available for use; the interior of the carrying case may be provided with various pockets, receptacles or other structure for retaining and/or organizing other contents; and the features of the present invention may be incorporated in various types of carrying cases including portfolios, notebooks, attache cases, briefcases, duffle bags and suitcases.

These and other objects, advantages and benefits are realized with the present invention as generally characterized in a carrying case comprising an enclosure including a plurality of external walls enclosing an interior defining at least one interior compartment. A selectively openable, selectively closable compartment opening in the enclosure provides access into the interior compartment when the compartment opening is open and prevents access into the interior compartment when the compartment opening is closed. The enclosure may be designed in a manner similar to a notebook with external front and back walls connected along a hinge line about which the front wall is pivotal to obtain open and closed positions for the carrying case, with the compartment opening extending between opposite ends of the hinge line. Alternatively, the enclosure may be designed as a suitcase or in any other suitable configuration. One of the external walls of the enclosure has a window therein in communication with the interior compartment and an external panel disposed over or within the window. The panel is pivotally moveable relative to the one of the external walls from a retracted position wherein the panel covers or closes the window and an extended position wherein the panel exposes the window. In the extended position, the panel may be pivoted exteriorly outwardly away from the one of the external walls. The panel defines a pop-out compartment adapted to carry at least one object, the pop-out compartment being disposed in and forming part of the interior compartment in the retracted position and being withdrawn from the interior compartment through the window in the extended position. The pop-out compartment may include a restraint for securing the object against an interior face of the panel, and the restraint may comprise a pocket for receiving the object and a strap cooperable with the pocket to secure the object therein. The restraint is preferably designed to hold an electronic device. More than one restraint may be provided on the interior face of the panel for holding more than more electronic device. A protective cover or shield may be provided along the interior face of the panel for enclosing or shielding the object in a closed or shielding position for the cover and for exposing or revealing the object in an open or non-shielding position for the cover. A fastener element may be provided for releasably securing the external panel in the retracted position. When the pop-out compartment is withdrawn from the interior compartment, the object or objects carried thereby can be removed from the enclosure via the withdrawn pop-out compartment independently of the compartment opening. When the pop-out compartment is disposed within the interior compartment with the panel in the retracted position, the object or objects carried thereby can still be removed from the enclosure via the compartment opening.

Other objects and advantages of the present invention will become apparent from the following description of the preferred embodiments taken in conjunction with the accompanying drawings wherein like parts in each of the several figures are identified by the same reference characters.

DESCRIPTION OF THE PREFERRED EMBODIMENTS

Figure 1:
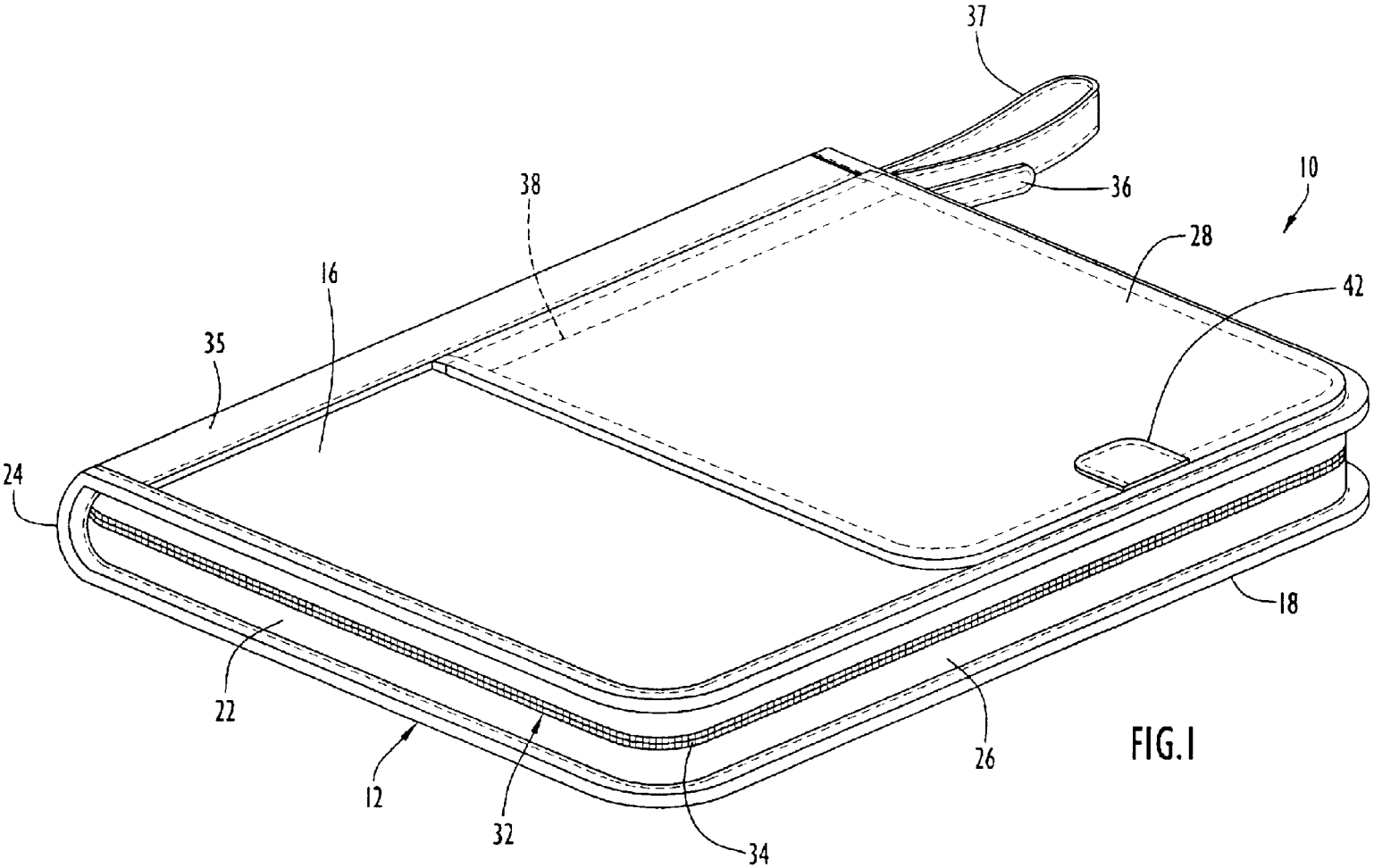
FIG. 1 is a perspective view of a carrying case according to the present invention depicting the carrying case in a fully closed position and a pop-out compartment of the carrying case in a retracted position.

A carrying case 10 according to the present invention is illustrated in FIGS. 1–4 and comprises a body or enclosure 12 enclosing an interior defining an interior compartment 14. The body 12 can have various external configurations and may be designed, for example, as a notebook, a portfolio, an attache case, a briefcase, a duffle bag, or a suitcase. The body 12 for carrying case 10 is similar to a notebook or portfolio and is defined by a plurality of external walls including a front wall 16, a back wall 18, a top wall 20, a bottom wall 22, a left side wall 24, a right side wall 26, and an external panel 28 on front wall 16 defining a pop-out compartment 29. It should be appreciated that the terms "front", "back", "top", "bottom", "left" and "right" are all relative terms applicable to the external walls 16–26, respectively, when the carrying case 10 is viewed and oriented as shown in FIGS. 1–4 but that each of the latter terms can apply to any of the external walls 16–26 depending on the orientation of the carrying case 10 and the direction from which the carrying case 10 is viewed. Accordingly, the terms "front", "back", "top", "bottom", "left" and "right" should not be construed as limiting the external walls 16–26. The external walls 16–26 can be planar or non-planar and can be rigid or non-rigid depending on the materials and construction for the carrying case 10. The carrying case 10 can be made of various rigid or non-rigid materials. In one embodiment, the external walls of the carrying case are made primarily of one or more durable fabrics with planar front and back walls 16 and 18 and planar panel 28 rigidified or reinforced for increased strength and for ease of use.

The external walls 16–26 can have various perimetric configurations, and the front wall 16 and back wall 18 for body 12 are shown as having rectangular perimetrical configurations with top edges joined to top wall 20, bottom edges joined to bottom wall 22, left side edges joined to left side wall 24 and right side edges joined to right side wall 26. Left ends of top wall 20 and bottom wall 22 are joined, respectively, to top and bottom ends of left side wall 24. Similarly, right ends of top wall 20 and bottom wall 22 are joined, respectively, to top and bottom ends of right side wall 26. The front wall 16 is similar to back wall 18 except the front wall has an opening or window 30 therein as explained further below. The external panel 28 is disposed over an exterior face of front wall 16 and is positionable to completely cover the window 30 as shown in FIG. 1 and as described further below. Accordingly, the panel 28 cooperates with the external walls to enclose the interior compartment 14.

Figure 2:
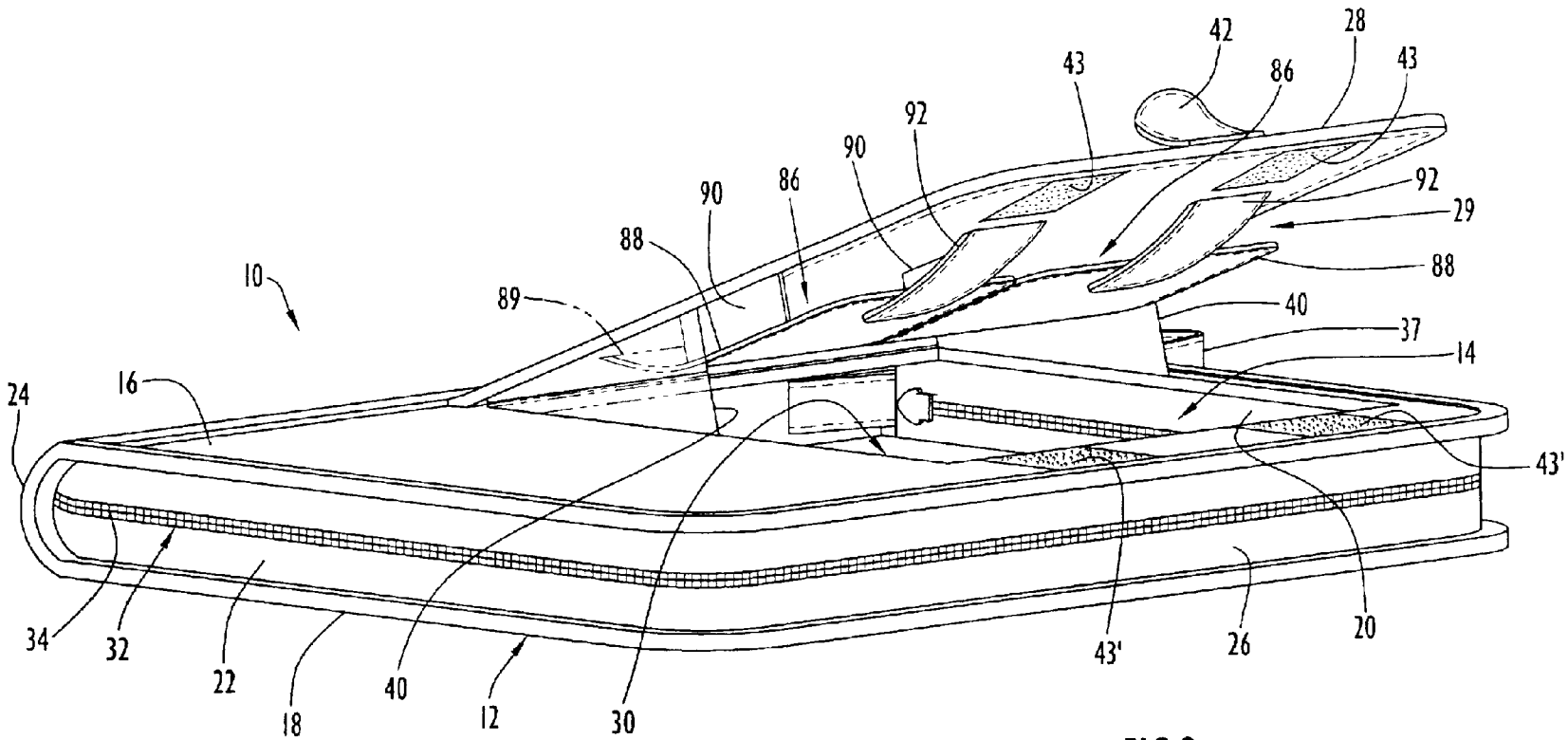
FIG. 2 is a perspective view of the carrying case depicting the carrying case in the fully closed position but with the pop-out compartment in a withdrawn position.
Figure 3:
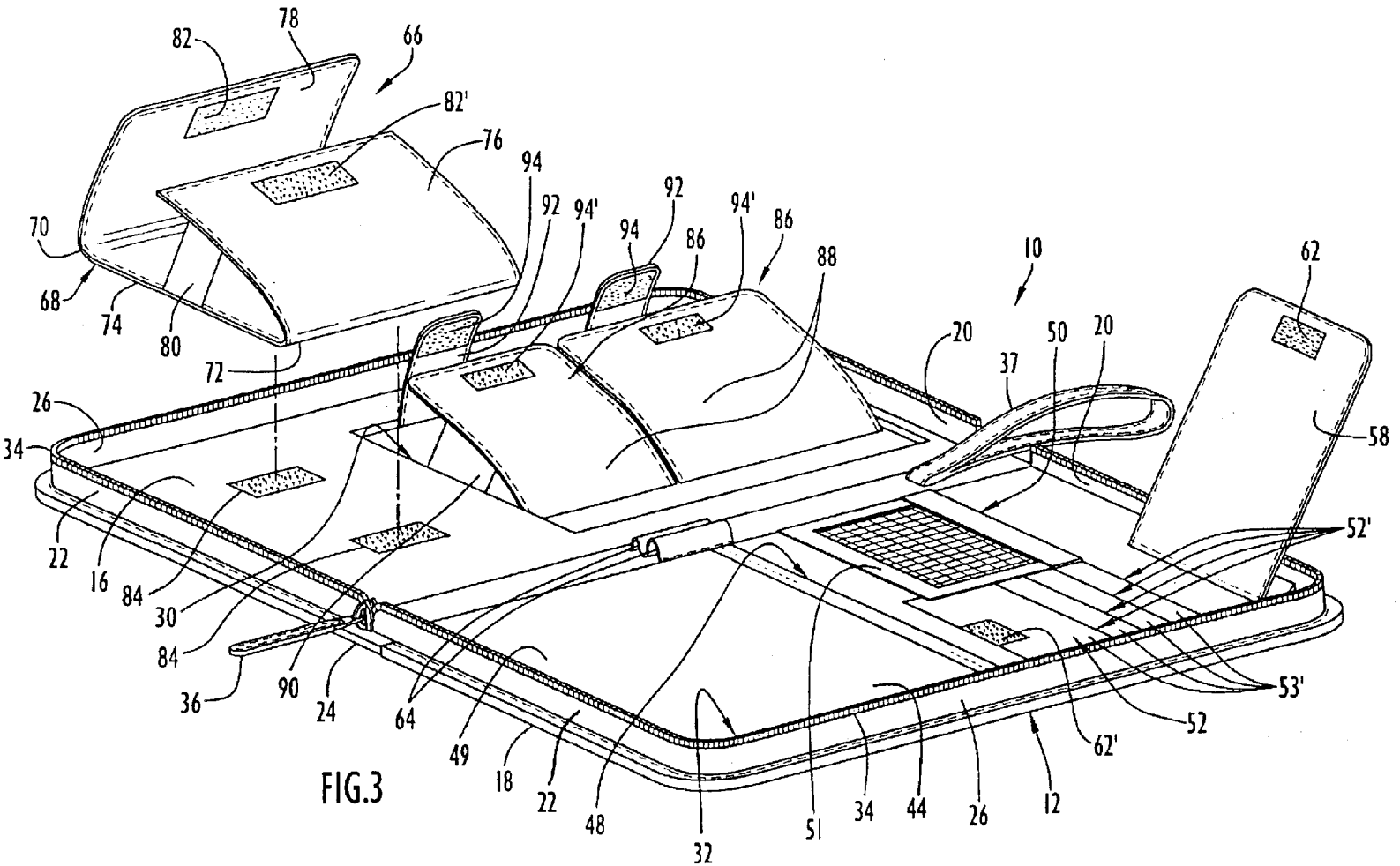
FIG. 3 is an exploded perspective view of the carrying case in a fully open position.
Figure 4:
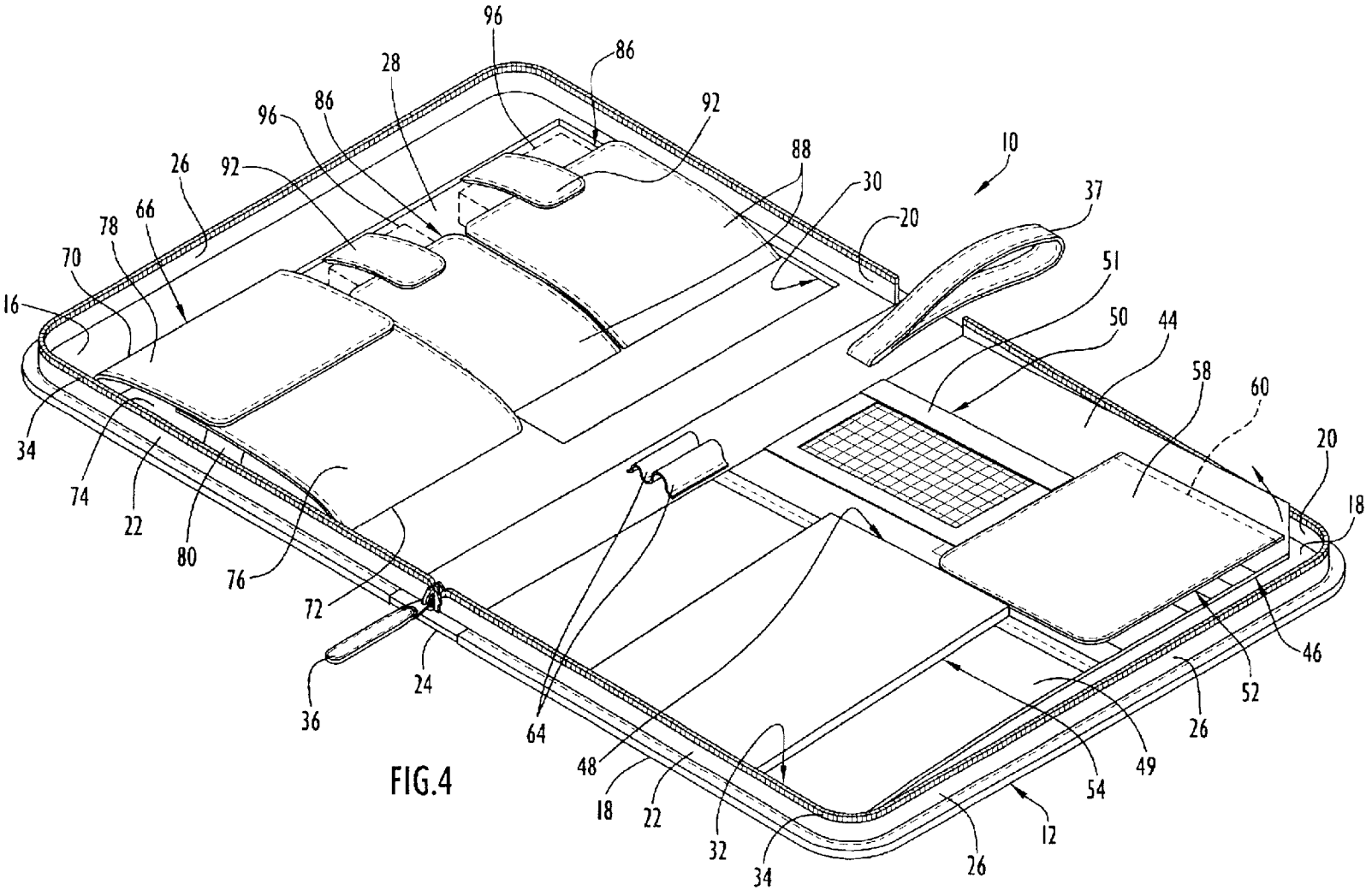
FIG. 4 is another perspective view of the carrying case in the fully open position.

A selectively openable, selectively closable compartment opening 32 provides access to the interior compartment 14. A closure 34 is provided for selectively opening and selectively closing the compartment opening 32. The opening 32 can be designed in various ways, with the opening 32 for carrying case 10 extending continuously and uninterruptedly along the entire length of top wall 20, the entire length of right side wall 26 and the entire length of bottom wall 22. The closure 34 can be designed in various ways depending on the design of the opening 32, and the closure 34 for carrying case 10 comprises a zipper extending along opposed edges of the opening 32. The zipper may include a tab 36 to facilitate grasping of the closure. When the zipper is completely or fully closed, the opening 32 is also completely or fully closed and the carrying case is in a completely or fully closed position as shown in FIGS. 1 and 2. When the zipper is completely or fully open, the opening 32 is also completely or fully open and the carrying case is in a completely or fully open position with maximum access to interior compartment 14 as shown in FIGS. 3 and 4. The fully closed and fully open positions are obtained via pivotal or rotational movement of front wall 16 and/or back wall 18 along a hinge, pivot or spine formed by left side wall 24. In one embodiment, the left side wall 24 is curved in the fully closed position for the carrying case 10 and may be structurally reinforced or rigidified via a layer of reinforcing material 35 secured to or forming part of the enclosure 12. The layer of reinforcing material 35 can be secured to or form part of the enclosure 12 in various ways including stitching as shown in dotted lines in FIG. 1 and/or adhesives.

In the fully open position, the carrying case 10 may be laid flat with the front wall 16 and the back wall 18 in the same or substantially the same plane. Of course, the front and back walls 16 and 18 can be oriented at various angles to one another in various partly closed or partly open positions for the carrying case even though the closure 34 may be fully open. Various partly closed or partly open positions may also be obtained for the carrying case when the closure 34 is partly closed/partly open so that the opening 32 is also partly closed/partly open, with the degree of access into the interior compartment 14 through the compartment opening 32 depending on the extent to which the closure 34 and/or opening 32 is/are partly closed/partly open. In some partly closed/partly open positions, the opening 32 may be opened such a small amount that the carrying case 10 is effectively in a closed position. In other partly closed/partly open positions, the opening 32 may be open an amount sufficient to allow objects to be removed from or placed in the interior compartment 14 through the compartment opening 32. Accordingly, the "closed position" for carrying case 10 includes the fully closed position as well as various partly closed positions, and the "open position" for carrying case 10 includes the fully open position as well as various partly open positions. Movement of the front and back walls 16 and 18 to obtain the closed and open positions is permitted due to flexure or bending of the left side wall 24. A loop 37 extends exteriorly from the enclosure 12 and protrudes through the opening 32 when the closure 34 is fully closed, the loop 37 forming a handle by which the carrying case may be grasped and carried. The loop 37 is illustrated as extending from the left side wall 24 to protrude from the top of the enclosure but may be provided at any suitable location.

The external panel 28 can have various perimetric configurations and sizes to cover or fit within the window 30 when the external panel and the pop-out compartment 29 are in a retracted or non-extended position as shown in FIGS. 1, 3 and 4. For carrying case 10, the external panel 28 has a rectangular perimetrical configuration corresponding to but larger in size than a rectangular configuration of the window 30 so that the perimetric edges of the external panel overlap the front wall 16 a small amount when the external panel is in the retracted position. Preferably, the external panel 28 in the retracted position completes or follows the configuration of the front wall 16 and, therefore, the external panel 28 is planar to complete or follow the planar configuration of the front wall 16. The external panel 28 in the retracted position thusly lies flush against the front wall 16 and is essentially a continuation of the front wall. The left side edge of external panel 28 is attached to the enclosure 12 along a pivot, hinge or attachment line 38 shown in FIG. 1, while the top, right and bottom side edges of the external panel remain unattached from the enclosure. The left side edge of external panel 28 can be attached, and preferably permanently attached, to the enclosure in various ways including stitching and/or adhesives along the left side edge of the external panel. For carrying case 10, the left side edge of external panel 28 is illustrated as being attached to the front wall 16 by stitching along attachment line 38 extending from the top side edge to the bottom side edge of the external panel. The attachment line 38 forms a hinge along which the external panel 28 is manually pivotal, movable or rotatable relative to the front wall 16 from the non-extended or retracted position to an extended or withdrawn position for the external panel and the pop-out compartment 29 as shown in FIG. 2, in which a right side of the external panel is moved outwardly away from the front wall 16 in the exterior direction. The pivot axis defined by the attachment line 38 is disposed along the plane of the front wall 16.

The top and bottom sides of the external panel 28 are connected to the front wall 16 by connecting members 40 which control or limit the extent of pivotal movement of the external panel in the extended position as shown in FIG. 2. Also, the connecting members 40 establish upper and lower boundaries for the pop-out compartment 29. The connecting members 40 are preferably made of elastic or stretchable material and may be used to impart a self-closing effect to the external panel 28 and the pop-out compartment 29 whereby the external panel and pop-out compartment 29 are biased to move from the extended position to the retracted position. The strength or force of the self-closing effect would depend on the elastic memory of the connecting members 40. The connecting members 40 can be designed in various ways and are shown by way of example as substantially V-shaped members respectively connected to the top and bottom side edges of external panel 28 and to the top and bottom edges of window 30. The connecting members 40 taper in the direction of left side wall 24 and can each be formed as a single piece or part or as a plurality of interconnected pieces or parts. The connecting members 40 may be pleated to expand when the external panel 28 is moved from the non-extended position to the extended position and to collapse or fold when the external panel is moved from the extended position to the non-extended position, with or without the webs being elastic.

A tab 42 is attached to the right side of the external panel 28 as shown in FIGS. 1 and 2 for grasping by a user to facilitate movement of the external panel and the pop-out compartment between the non-extended and extended positions. The tab 42 is located along the right side edge of external panel 28 midway between the top and bottom side edges of the external panel. However, it should be appreciated that the tab 42 can be at any suitable location. One or more fastener elements 43 are provided on an interior face of panel 28 for releasable, cooperable engagement with corresponding fastener elements 43' on the exterior face of front wall 16. The fastener elements 43, 43' can be designed in various ways and are depicted as being made of complementary hook and loop material such as Velcro. The fastener elements 43, 43' are located near the right side edges of the panel 28 and front wall 16, and the fastener elements 43, 43' releaseably secure the panel 28 in the retracted position.

It should be appreciated from the above that movement of the external panel 28 from the retracted position to the extended position causes the pop-out compartment 29 to be extended or withdrawn from the carrying case and provides access to the interior compartment 14 from externally of the carrying case independent of compartment opening 32. The external panel 28 can be provided with a distinctive appearance as a visual indication to the user of the distinctive function of the external panel. As an example, the external panel can be made of a material visually and/or tactilely different than the material of front wall 16.

The interior compartment 14 of carrying case 10 is illustrated in FIGS. 2–4. The pop-out compartment 29 is disposed in and forms part of the interior compartment 14 in the retracted position and is withdrawn from the interior compartment in the extended position. FIG. 2 depicts the pop-out compartment 29 as accessed via movement of the external panel 28 and pop-out compartment 29 to the extended position independently of compartment opening 32 in that the opening 32 is depicted as being fully closed via the closure 34. FIGS. 3 and 4 depict the pop-out compartment 29 as accessed via pivotal movement of the front wall 16 and/or the back wall 18 to obtain the fully open position for carrying case 10 when the compartment opening 32 is fully open via closure 34.

As best shown in FIGS. 3 and 4, the interior compartment 14 contains a partition 44 disposed over back wall 18 and having top, bottom, left and right side edges extending, respectively, along the top, bottom, left and right and side edges of back wall 18. The partition 44 could be non-planar but is depicted as being planar with a perimetrical configuration corresponding to the perimetrical configuration of back wall 18 and a perimetrical size slightly smaller than the perimetrical size of back wall 18 such that the partition 44 fits closely within the interior. The partition 44 is attached to the back wall 18 along the left side edge of the partition and along the bottom side edge of the partition. The partition is continuously attached to the back wall along the left and bottom side edges of the partition, and the partition may be attached to the back wall in various ways such as stitching and/or adhesives. The top side edge and the right side edge of the partition 44 remain unattached from the back wall 18. The partition 44 has a back face facing an interior face of back wall 18 and a front face opposite the back face thereof. A space 46, shown in FIG. 4, is available between partition 44 and back wall 18, the space 46 being accessed by lifting or moving the unattached side edges of the partition away from the back wall as shown by the arrow in FIG. 4. The top right corner of the partition may be beveled as further shown in FIG. 4 to facilitate manual grasping and moving of the partition away from the back wall to access space 46. The space 46 may be used as a storage space for various objects, and objects within space 46 will be separated or isolated from the remainder of the interior compartment 14 by the partition 44. It should be appreciated that the size and dimensions of the space 46 can vary depending on the design of the carrying case.

The front face of partition 44 carries a variety of organizing structures which may include one or more pockets, three pockets 48, 50 and 52 being shown in FIGS. 3 and 4 along the front face of the partition. Pocket 48 is formed by a pocket member 49 having bottom, left and right side edges attached to partition 44 and a top side edge that is at least partly unattached from partition 44 to define an opening into the pocket 48. The pocket member 49 can be attached to the partition 44 in many various ways including stitching and/or adhesives. The pocket 48 can have any suitable dimension or size. The pocket 48 is shown with the bottom side edge of the pocket member 49 adjacent the bottom wall 22, with the left side edge of the pocket member 49 adjacent the left side wall 24 and with the right side edge of the pocket member 49 adjacent the right side wall 26. The top side edge of the pocket member 49 terminates about mid-way between the top and bottom side edges of partition 44, but the pocket 48 can have any desired height. In the case of pocket 48, left and right segments of the top side edge of pocket member 49 are attached to the partition 44 such that the opening into pocket 48 is disposed between the attached left and right segments as best shown in FIGS. 3 and 4, which shows the left and right segments of the top side edge of pocket member 49 attached to partition 44 by stitching. Of course, any selected number of segments of the top side edge of the pocket member 49 could be attached to the partition 44 at various locations in various ways, including stitching and/or adhesives, to provide one or more openings into the pocket 48 and/or to provide a plurality of pockets. Also, the top side edge of the pocket member 49 can remain unattached from the partition in its entirety to define one continuous opening into the pocket 48 extending from the left side edge to the right side edge of the pocket member. The size of the opening or openings for the pocket 48 along the top side edge of the pocket member 49 can be selected to accommodate or mount specific objects. For example, the pocket 48 is designed to mount a standard memo pad 54 with a backing of the memo pad inserted in the pocket 48 and the paper sheets of the memo pad disposed over the front face of the partition as depicted in FIG. 4. The backing of the memo pad is confined laterally between the left and right segments of the top side edge of pocket member 49 attached to partition 44. The paper sheets of the memo pad can be accessed and can be written upon when the carrying case is in a sufficiently open position without removing the memo pad from the pocket 48.

The pocket 50 is disposed on partition 44 above the pocket 48 and adjacent the left side wall 24. The pocket member 51 for pocket 50 has its bottom, left and right side edges attached to the partition and has its top side edge unattached from the partition to define an opening into the pocket 50. The pocket 50 has a configuration and size to receive a standard business card or the like, and at least a central portion of the pocket member 51 is fabricated of a material permitting visualization through the pocket member 51 of a card within the pocket 50. As shown by way of example, a central portion of pocket member 51 is made of an open mesh material circumscribed by a solid border of the pocket member 51, such that a business card disposed within the pocket 50 can be visualized through the open mesh material.

As best shown in FIG. 3, the pocket 52 comprises a plurality of overlapping sub-pockets 52', each formed by a pocket member 53' having bottom, left and right side edges attached, such as by stitching and/or adhesives, to the partition 44. The top side edges of the pocket members 53' are parallel to one another and are unattached from the partition 44 to define respective openings into the pockets 52'. The pocket members 53' are arranged vertically in series, with the pocket members 53' in overlapping arrangement. The top of the bottommost pocket member 53' overlaps the bottom of the next upper adjacent pocket member 53' with the top side edge of the next upper adjacent pocket member exposed beyond the top side edge of the bottommost pocket member and so on for the remaining pocket members 53'. Accordingly, the opening of each pocket 52' is exposed and is spaced above the opening of the next lower adjacent pocket. The pockets 52' each have a size and configuration to receive an object such as a standard plastic card or the like, as typically used for credit cards, ATM cards, phone cards, identification cards and the like. The dimensions of the pockets 52' are selected such that the top edges of adjacent plastic cards received therein are exposed and spaced above one another in a manner similar to the top side edges of the pocket members 53' such that a top edge of each card is visible and exposed to facilitate grasping and removal of the card from its pocket 52'. The pockets 52' can be arranged vertically as shown, horizontally or in any desired manner. Any number of pockets 52' can be provided, the carrying case 10 being shown with four pockets 52'.

The pocket 52 comprising the array of pockets 52' is covered by a releasable flap or cover 58 shown in FIGS. 3 and 4. The flap 58 has an external configuration and size to cover or to substantially cover the array of pockets 52' and is pivotally attached to partition 44 for movement between an exposing position shown in FIG. 3 and a protecting position shown in FIG. 4. The flap 58 can be pivotally attached to the partition in various ways and at various locations. The flap 58 for carrying case 10 has a top side edge disposed parallel to the top side edges of pocket members 53' and attached to the partition 44 along an attachment line 60 spaced above the top side edge of the topmost pocket member 53'. The flap 58 can be attached to the partition 44 in various ways including stitching and/or adhesives. The flap 58 has a rectangular configuration to cover or substantially cover the array of pockets 52' and has bottom, left and right side edges unattached from the partition 44. As shown in FIG. 3, a fastener element 62 is disposed on a back face of flap 58 near the bottom side edge thereof for cooperatively engaging a corresponding fastener element 62' on the bottommost pocket member 53'. The fastener elements 62, 62' can be designed in various ways and are shown by way of example as being made of complementary hook and loop material such as Velcro. In the protecting position for flap 58 as shown in FIG. 4, the flap 58 covers and overlaps the pocket 52 and is held in the protecting position via engagement of fastener element 62 with fastener element 62'. The flap 58 disposed over the pocket 52 in the protecting position protects one or more plastic cards or the like disposed in the pockets 52' by isolating the cards from contact with other contents within the interior compartment 14, by preventing inadvertent removal of the cards from the pockets 52', and by protecting the security and confidentiality of the cards. It should be appreciated that the organizing structure comprising pockets 48, 50 and 52 and/or other types of organizing structure can be arranged on the front face of partition 44 in many various ways.

For maximum utility, organizing structure of various types can also be provided on an interior face of side wall 24 as well as on an interior face of front wall 16. As shown in FIGS. 3 and 4, for example, one or more sleeves 64 may be provided on the interior face of left side wall 24. Two adjacent sleeves 64 are illustrated in FIGS. 3 and 4 extending longitudinally side-by-side along the left side wall 24 parallel to right side wall 26 and to the hinge or pivot defined by the left side wall. The sleeves 64 may be secured on the left side wall 24 in many various ways including stitching and/or adhesives. Each sleeve 64 cooperates with the interior face of the left side wall 24 to define a longitudinal passage open at opposing ends and having a cross-sectional size to receive an object such as a writing implement including pens, pencils and the like.

As shown in FIGS. 3 and 4, a receptacle 66 is removably secured on the interior face of front wall 16, and the receptacle 66 can be secured at any suitable location depending on the location of window 30. The receptacle 66 is shown as being disposed between the bottom side edge of window 30 and the bottom wall 22. The receptacle 66 is oriented sideways on front wall 16 but the receptacle can be oriented in any desired direction or orientation. The receptacle 66 comprises a casing 68 formed by a flat rectangular panel folded along parallel upper and lower hinge or fold lines 70 and 72 to form a back segment 74 and overlapping first and second front segments 76 and 78. The first front segment 76 overlaps the back segment 74 and is attached to the back segment 74 via a pair of connecting members 80 extending between the first front segment 76 and the back segment 74 along opposing side edges of the casing 68. Only one connecting member 80 is visible in FIGS. 3 and 4. The back segment 74 and the first front segment 76 form a pocket for receiving one or more objects, and the second front segment 78 overlaps the back segment as well as the first front segment to define a closure or lid for the pocket. A portion of the second front segment 78 that overlaps the first front segment 76 has a fastener element 82 along its inner face cooperatively releasably engagable with a corresponding fastener element 82' on the outer face of the second front segment. The fastener elements 82, 82' can be designed in many various ways and are illustrated as being made of cooperatively engagable hook and loop material such as Velcro.

The first front segment 76 is pivotable about fold line 72 for movement toward and away from the back segment 74 to facilitate the positioning of an object or objects between the first front segment and the back segment. The connecting members 80 limit or control the maximum extent to which the first front segment 76 may be pivoted away from the back segment 74 and also define the lateral dimension of the receptacle. The connecting members 80 may be made of elastic material to provide a self-closing effect for the receptacle 66 in that the elasticity of the connecting members 80 may be used to bias or cause the first front segment 76 to spring back toward the back segment 74. The second front segment 78 is pivotable around fold line 70 between an open position for the receptacle 66 shown in FIG. 3 and a closed position for the receptacle shown in FIG. 4. In the open position for receptacle 66, the second front segment 78 is pivoted away from the first front segment 76 to establish access into the pocket of the receptacle for the introduction of objects. In the closed position for receptacle 66, the second front segment 78 is pivoted into overlapping abutment with the first front segment 78, and the fastener elements 82 and 82' are in releasable engagement to releasably secure the second front segment to the first front segment and thereby close the pocket of the receptacle. In order to thereafter obtain the open position for the receptacle 66, the second front segment 78 is merely grasped and pivoted away from the first front segment 76 to disengage the fastener elements 82 and 82'. An outer face of back segment 74 is provided with fastener elements (not visible in FIG. 3) that are cooperatively releasably engagable with corresponding fastener elements 84 on the interior face of front wall 16. The fastener elements 84 and the corresponding fastener elements on the receptacle 66 can be designed in various ways and are illustrated as being made of cooperatively releasably engagable hook and loop material such as Velcro. The fastener elements 84 and the corresponding fastener elements on the receptacle 66 a low the receptacle 66 to be releasably secured in place on the front wall and to be selectively removed or detached from the front wall by disengaging the fastener elements so that the receptacle 66 may be used independently of the carrying case 10. The receptacle 66 can have any configuration or dimension and can be designed with a particular configuration and dimension to receive a particular type of object including an electronic device.

At least one restraint 86 is disposed on the interior face of external panel 28 for securing an object and preferably a plurality of restraints 86 are disposed on the interior face of the exterior panel for securing more than one object, two such restraints 86 being shown for carrying case 10. The restraints 86 are similar to one another and each restraint comprises a pocket oriented sideways on external panel 28 with openings into the pockets facing toward right side wall 26. Each restraint or pocket 86 comprises a pocket member 88 having a lower edge attached to the external panel 28 along an attachment line 89 and having unattached upper and opposing side edges. The lower edges of the pocket members 88 can be attached to the external panel 28 in many various ways including stitching and/or adhesives. The unattached opposing side edges of each pocket member 88 are connected to the external panel 28 by opposed connecting members 90 which define the lateral dimension of the pocket. Each pocket member 88 is pivotable around its attachment line 89 to allow the unattached upper portion of the pocket member to be moved toward and away from the external panel 28 to facilitate insertion and removal of objects in the pockets 86. FIG. 3 illustrates the pocket members 88 pivoted away from the external panel 28 to enlarge the opening into pockets 86, the connecting members 90 limiting or controlling the extent of pivotal movement of the pocket members 88 away from the external panel 28. The connecting members 90 may be made of an elastic or stretchable material to provide a self-closing effect by which the pocket members 88 spring back toward the external panel from an outwardly pivoted position such as that shown in FIG. 3.

Each restraint or pocket 86 may further comprise a closure 92 comprising a strap extending transverse to the opening of the pocket and having one end attached to the external panel 28 and an opposite end carrying a fastener element 94 cooperatively releasably engagable with a corresponding fastener element 94' on the pocket member 88. FIG. 3 shows the straps with their fastener elements 94 detached from the fastener elements 94' such that the pockets 86 are open for insertion and removal of electronic devices therein. FIG. 4 depicts the straps releasably secured to the pocket members 88 via engagement of the fastener elements 94 with the fastener elements 94' so that the pockets 86 are closed due to the openings into the pockets being obstructed by the closures 92. In FIG. 4, electronic devices 96 such as cellular phones are shown inserted in pockets 86, with portions of the electronic devices protruding from the pocket openings. The closures 92 extend over the protruding portions of the electronic devices to prevent inadvertent removal of the electronic devices from the pockets. The restraints or pockets 86 formed by pocket members 88 and closures 92 are of a size and configuration to snugly receive the electronic devices so that movement of the electronic devices within the pockets is restricted when the closures are releasably engaged with the pocket members. Accordingly, the electronic devices are stabilized within the pockets and are protected from displacement.

When the carrying case 10 is in the closed position with the external panel 28 and pop-out compartment 29 in the retracted position, the electronic devices 96 received within pockets 86 are disposed in the interior compartment 14. The pop-out compartment 29 is also disposed in the interior compartment, with the pockets 86 protruding interiorly through the opening 30 in front wall 16. An interior side of the pop-out compartment is open to the interior compartment. The electronic devices 96 are secured on the external panel 28 via the restraints 86 and are thusly confined to the pop-out compartment as well as being restricted from displacement within the interior. Also, the front wall 16 and external panel 28 provide structural protection for the electronic devices. The electronic devices 96 may be accessed via the compartment opening 32 by opening the closure 34, and the electronic devices can be removed from and inserted in the pockets 86 for removal from and placement in the interior compartment 14 via the compartment opening.

It is sometimes inconvenient for a user to have to remove the electronic devices from and place the electronic devices in the interior compartment 14 via the compartment opening 32, especially since the electronic devices may require frequent removal from and insertion in the carrying case. The external panel 28 allows the electronic devices 96 to be accessed independently of the compartment opening 32 for removal from and placement in the interior compartment 14. As shown in FIG. 2, the external panel 28 is manually pivotable from the retracted position to the extended position, typically by the user grasping and pulling on tab 42 to move the panel away from front wall 16. Movement of the external panel 28 from the retracted position to the extended position results in withdrawal of the pop-out compartment 29 from the interior compartment 14 and establishes access to the pockets 86 even when the compartment opening 32 is closed via the closure 34. Particularly, movement of the external panel 28 and the pop-out compartment 29 to the extended position causes the pockets 86 to be moved exteriorly outwardly therewith, with the pockets moving through the opening 30 in front wall 16. The external panel 28 is extended outwardly from the front wall 16 at an angle to advantageously position the pockets 86 for removal of electronic devices 96 therefrom and/or for insertion of electronic devices 96 therein. The openings into the pockets 86 and the closures 92 are adjacent the edge of the external panel 28 that is pivoted away from the front wall 16 so that the closures 92 are readily and conveniently accessible and the electronic devices 96 received within the pockets are also readily and conveniently accessible via the space created when the external panel is in the extended position. In order to return the external panel 28 and pop-out compartment 29 to the retracted position, the external panel need only be moved interiorly, inwardly toward the front wall 16 so that the pockets 86 move inwardly through the opening 32 to be disposed once again in the interior compartment 14. Where a sufficiently strong self-closing effect is provided for the external panel 28 and pop-out compartment 29, the external panel need only be released by the user in order to spring back to the retracted position.

Figure 5:
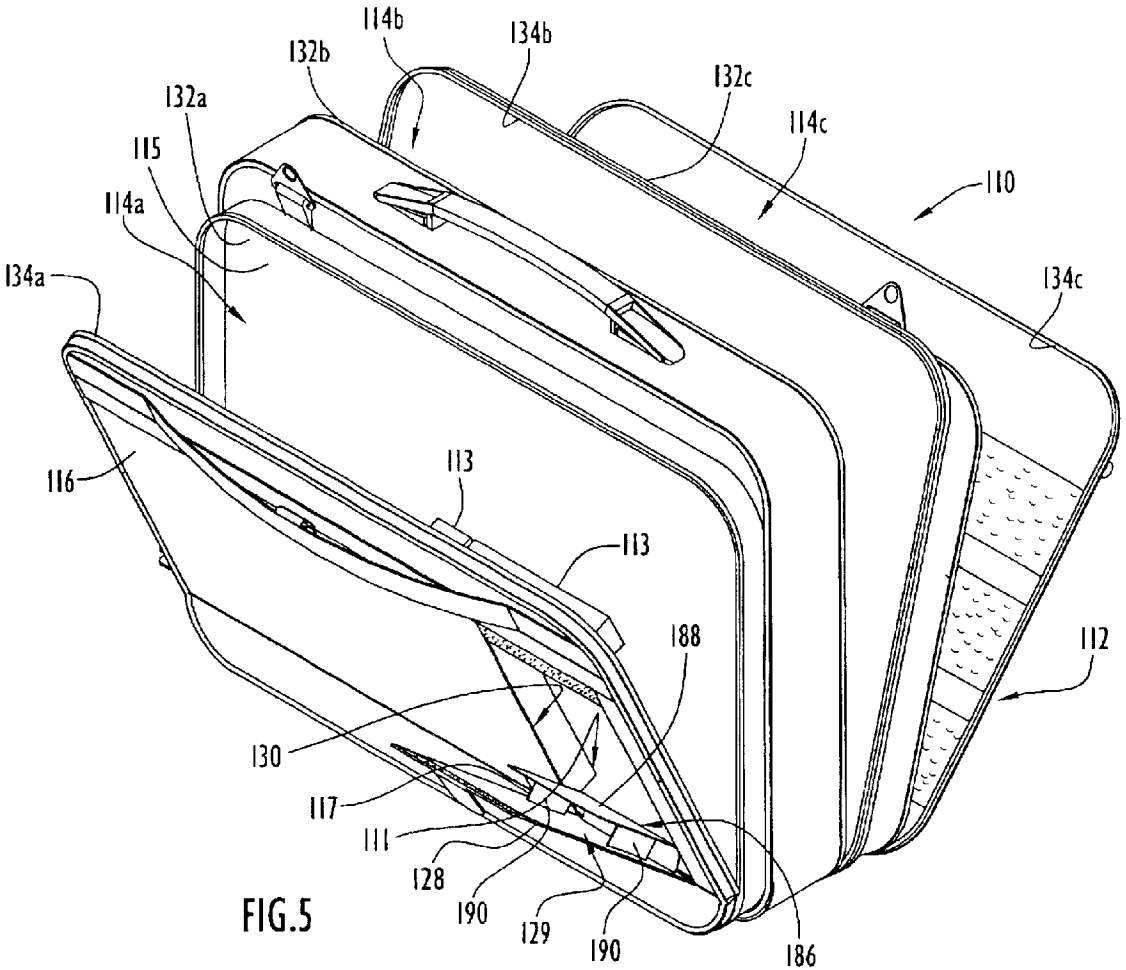
FIG. 5 is a perspective view of an alternative carrying case according to the present invention with the pop-out compartment in the withdrawn position.
Figure 6:
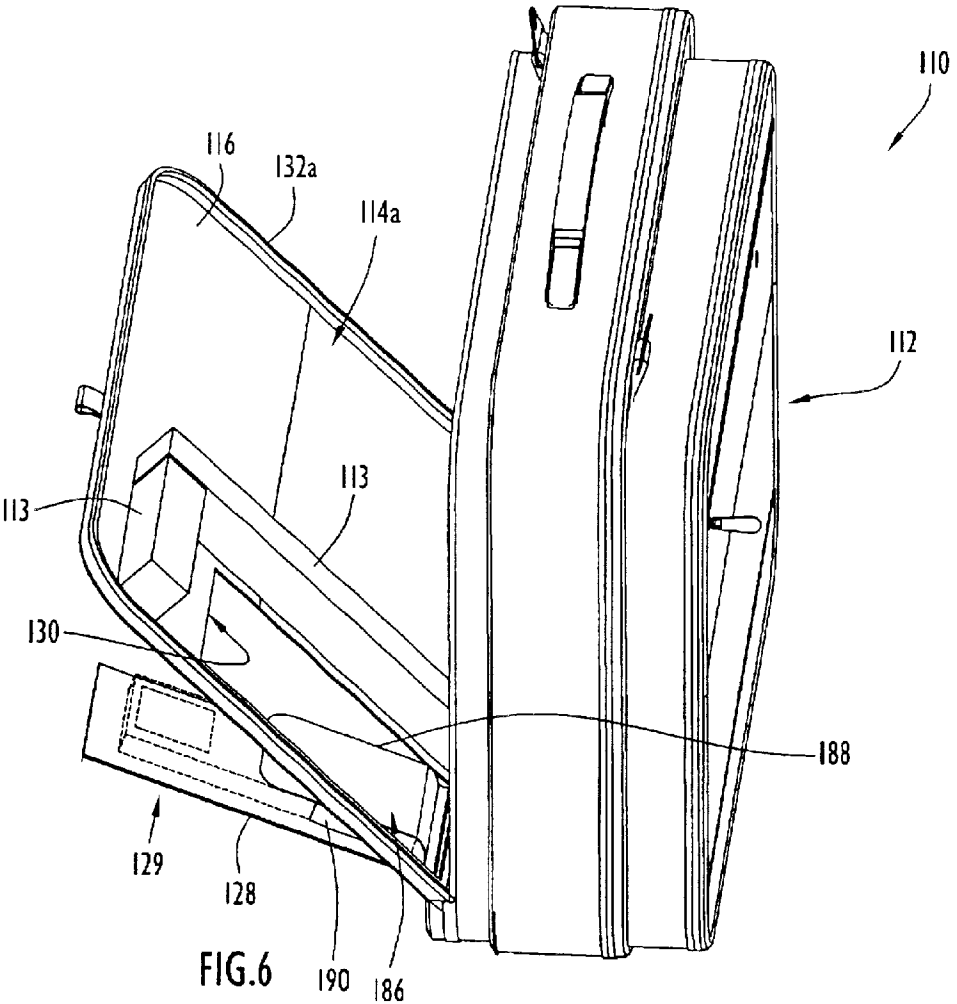
FIG. 6 is a perspective view of an interior compartment of the alternative carrying case into which the pop-out compartment is retractable.

An alternative carrying case according to the present invention is illustrated at 110 in FIGS. 5 and 6. Carrying case 110 comprises an enclosure 112 configured as a suitcase and defining a plurality of interior compartments, particularly interior compartments 114*a*, 114*b* and 114*c* each having a selectively openable, selectively closable compartment opening 132*a*, 132*b* and 132*c* with zipper closures 134*a*, 134*b* and 134*c*. Interior compartment 114*b* is disposed between interior compartments 114*a* and 114*c*. The compartment 114*b* may be designed to carry a laptop or notebook computer, and the dimensions of interior compartment 114*b* may be selected to closely accommodate standard sizes of laptop or notebook computers. An external wall 116 of carrying case 110 has window 130 therein communicating with interior 114*a*, and a pop-out compartment 129 is associated with external wall 116. The interior compartment 114*a* is defined between external wall 116 and an internal surface or compartment wall 115 and, as shown in FIGS. 5 and 6, the external wall 116 is pivotal or movable relative to the compartment wall 115 from a closed position in which the compartment opening 132*a* is closed and the compartment 114*a* has a compartment depth between an interior face or side of external wall 116 and the internal surface or wall 115. The pop-out compartment 129 is depicted in a withdrawn position in FIGS. 5 and 6 and is similar to pop-out compartment 29 except that the external panel 128 for pop-out compartment 129 fits partly within the window 130 and except that the restraint 186 for pop-out compartment 129 is different than restraint 86. In addition, the pop-out compartment 129 is provided with a spacer or bumper 111 for closing off he pop-out compartment from the interior compartment 114*a* in the retracted position. In the case of pop-out compartment 129, the top and bottom side edges of the external at panel 128 fit within the top and bottom side edges of window 130. The restraint 186 comprises a pocket member 188 and connecting members 190 defining a pocket for receiving an object but does not include a closure. One restraint 186 is provided on external panel 128, and the pocket formed by pocket member 188 and connecting members 190 is preferably dimensioned to accommodate an electronic device, particularly a PDA, with a portion of the electronic device protruding from the pocket opening to facilitate grasping thereof.

The spacer or bumper 111 is best shown in FIG. 6 and comprises block member including one or more blocks 113 permanently or removably secured in compartment 114*a* on the interior face or side of external wall 116 while being unattached to the panel 128. The one or more blocks 113 contact or abut the interior side of external wall 116, and the one or more blocks move with the external wall 116 when the external wall 116 is moved relative to the compartment wall 115 from the closed position as depicted in FIGS. 5 and 6. As seen from FIGS. 5 and 6, the compartment wall 115 is of unitary continuity and is coextensive with the interior side of external wall 116. The compartment wall 115 is spaced from and faces the interior side of external 116 to define the compartment 114*a*. In other words, the compartment wall 115 extends coextensively with the interior side of external wall 116 from side to side and from top to bottom of the interior side of external wall 116 but in spaced relation with the interior side of external wall 116 when compartment 114*a* is defined therebetween. The block member for carrying case 110 comprises two blocks 113 extending along the top and right sides of window 130, respectively, such that the spacer 111 at least partially circumscribes the window. The block member may be disposed adjacent the edge of window 130 or may be disposed on the interior face or side of external wall 116 a distance from the edge of the window 130. The one or more blocks 113 have a depth between parallel abutment surfaces of the spacer defining a spacer depth protruding interiorly fixedly perpendicular to the interior face or side of external wall 116, and the spacer depth corresponds to or approximate the compartment depth for interior compartment 114*a* between the interior face or side of external wall 116 and the internal surface or compartment wall 115 facing the interior side of external wall 116 in the closed position. Accordingly, when the interior compartment 114*a* is closed, with its compartment opening 132*a* closed via closure 134*a*, one abutment surface of the spacer contacts or abuts the internal surface or compartment wall 115 and the other abutment surface contacts or abuts the interior side of external wall 116 such that the spacer 111 maintains the compartment depth and the spacing between the external wall 116 and the compartment wall 115. The pop-out compartment 129 is isolated by the spacer or bumper 111 from the remainder of interior compartment 114*a* defined between the compartment wall 115 of unitary continuity and the external wall 116. In this manner, other objects disposed within interior compartment 114*a* are prevented from entering the pop-out compartment 129, the interior side of which is closed to the interior compartment 114*a*. The object within the pop-out compartment 129 is thusly protected against damage due to contact with other objects within the compartment 114*a* and, when the pop-out compartment is moved to the withdrawn position for removal of the object therefrom, other objects within compartment 114*a* do not interfere with such removal. When the pop-out compartment 129 is in its retracted position, the object within the pop-out compartment can still be removed from and placed in the interior compartment 114*a* by opening the compartment opening 132*a* to move the external wall 116 away from the internal compartment wall 115 a sufficient amount. It should be appreciated that, depending on the design of the external wall and the pop-out compartment, the one or more blocks 113 may extend along all or less than all sides of the window. A holder 117, shown in FIG. 5, may be attached to the interior face of external panel 128 for holding an accessory used with an object carried by restraint 186. The holder 117 is configured as a tubular sleeve overlapping one of the connecting members 190 for removably holding a stylus used with a PDA to be carried by the restraint 186.

Figure 7:
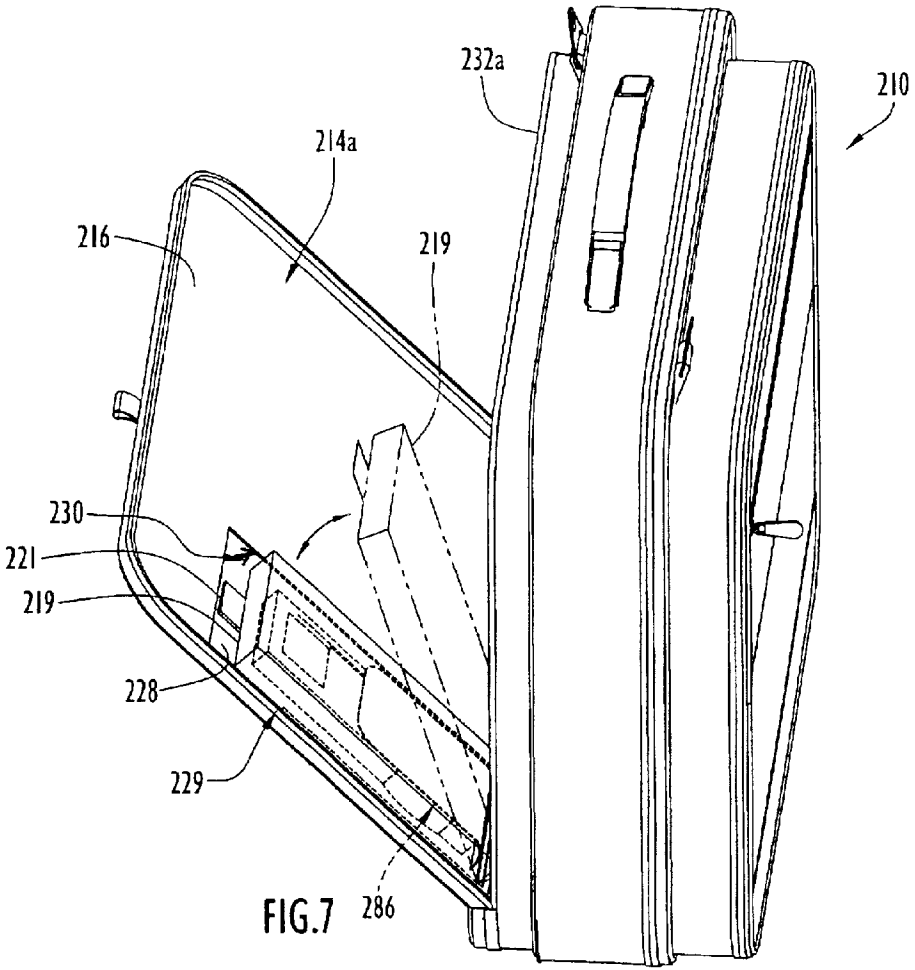
FIG. 7 is a perspective view of an interior compartment of another alternative carrying case depicting a modified pop-out compartment.

FIG. 7 depicts carrying case 210, similar to carrying case 110, having a modified pop-out compartment 229 including a cover or shield 219. Pop-out compartment 229 is similar to pop-out compartment 129 except that pop-out compartment 229 has the cover or shield 219 pivotally mounted to the interior face of panel 228. The cover 219 has a peripheral edge, a portion of which is attached to the external panel 228 along an attachment line parallel to the left side edge of window 230. The remainder of the peripheral edge of cover 219 is unattached to the external panel 228, and the attachment line forms a hinge or pivot along which the cover 219 is manually pivotal, movable or rotatable relative to the external panel 228 from a closed or shielding position shown in solid lines to an open, non-shielding or revealing position shown in dotted lines. The periphery of the cover fits within the periphery of external panel 228 and, in the closed position for the cover 219, the unattached portion of the peripheral edge of the cover is disposed adjacent or in contact with the interior face of external panel 228 so that the pop-out compartment 229 is enclosed externally by the external panel 228 and internally by the cover 219. The cover 219 has a size and configuration such that the enclosed pop-out compartment 229 can accommodate an object and, in particular, an electronic device such as a PDA. The restraint 286 is disposed within the enclosed pop-out compartment; however, a restraint may be eliminated where a cover is provided since the cover may function as a restraint. With the cover 219 in the closed position, an object within the enclosed pop-out compartment 229 is stabilized, isolated and protected. Preferably, the cover 219 is made of a rigid material to maintain the configuration of the enclosed pop-out compartment 229. In the retracted position for the enclosed pop-out compartment 229, other objects within the interior compartment 214*a* are prevented from entering the enclosed pop-out compartment such that the object therein is protected and is also segregated to facilitate its withdrawal. Even where no object is disposed in the enclosed pop-out compartment, other objects within the interior compartment 214*a* are prevented from entering the pop-out compartment 229 so that the pop-out compartment is always ready to receive an object without requiring the user to move or rearrange other objects within the interior compartment. As discussed above, similar effects may be obtained with a bumper or spacer. A spacer or bumper as described above can be provided in conjunction with cover 219; however, a spacer or bumper can be eliminated where cover 219 is provided. An object can be removed from or placed in the enclosed pop-out compartment 229 via the compartment opening 232*a* in that the cover 219 need only be moved from the closed position to the open position by inserting a hand in the interior compartment 214*a* through the compartment opening and manually grasping and pivoting the cover 219 away from the external panel 228. When the cover 219 is pivoted away from the external panel 228 in an interior direction, the pop-out compartment 229 is no longer enclosed but, rather, is accessible or open along its interior side for removal of an object from or insertion of an object therein. Once an object is removed from or placed in the pop-out compartment 229 via access gained through the compartment opening, the cover 219 need only be pivoted back to the closed position to again enclose the pop-out compartment 229. An object can also be removed from or placed in the pop-out compartment 229 by moving the pop-out compartment from its retracted position to its withdrawn position, the cover 219 moving exteriorly through the window 230 as the external panel 228 is withdrawn, and thereafter pivoting the cover 219 from its closed position to its open position to gain access into the pop-out compartment. The cover 219 may be releasably secured in its closed position via a suitable fastener, including fastener elements made from complimentary hook and loop material as described above. Typically, a fastener element would be provided on the cover 219 along its right side edge, as shown by fastener tab 221, cooperatively releasably engageable with a corresponding fastener element provided on the interior face of external panel 228. The tab 221 can also be used for grasping. The cover 219 will typically be moved between its closed and open positions by grasping the right side edge or tab of the cover opposite its attachment line, and the right side edge or tab of the cover is advantageously positioned near the compartment opening 232*a* to facilitate access to the cover via the compartment opening or via the space created when the pop-out compartment is moved to the withdrawn position.

The pop-out compartments are readily and conveniently accessible regardless of the orientation of the carrying cases. The external panels need only be pivoted a relatively small amount away from the external walls in order to access objects, such that the objects can be inserted in and removed from the interior compartments when the carrying cases are in a confined or restricted space or area. The direction of pivoting for the external panels relative to the external walls may be the same as the direction of pivoting for the external walls themselves for simplified use and enhanced user familiarity. The external panels may also serve to distinguish the fronts of the carrying cases from the backs of the carrying cases and serve to distinguish the pop-out compartments. Since the external panels are distinguishable both visually and tactilely from the external walls, the external panels allow immediate recognition by the user as to the location of the pop-out compartments. The external panels may be disposed in overlapping arrangement with the external walls or in co-planar arrangement with the external walls. Accordingly, the external panels may be disposed over the windows or may fit within the windows partly or entirely. An object is secured on the external panels and is thereby stabilized and isolated during movement of the external panels and the pop-out compartments to the retracted and extended positions for greater protection of the object during retraction and extension of the pop-out compartments. Various structures can be used to separate or close off the pop-out compartments from the interior compartments in the retracted position including bumpers and covers. Where covers are used, the pop-out compartments remain closed in the withdrawn position until the covers are moved to the open position.

Inasmuch as the present invention is subject to many variations, modifications and changes in detail, it is intended that all subject matter discussed above or shown in the accompanying drawings be interpreted as illustrative only and not be taken in a limiting sense.

What is claimed is:

1. A carrying case comprising an enclosure comprising a plurality of external walls enclosing an interior, one of said external wells having a window therein in communication with said interior and a panel pivotally mounted to said one of said external walls, said panel being pivotal relative to said one of said external walls from a retracted position wherein said panel closes said window and an extended position wherein said panel is pivoted exteriorly outwardly away from said one of said external walls to open said window, said panel having an interior face for carrying an object disposed in said interior when said panel is in said retracted position and withdrawn from said interior when said panel is in said extended position, said one of said external walls having an interior side and said enclosure having an internal surface of unitary continuity spaced from and facing said interior side, said internal surface being coextensive with said interior side, said one of said external walls being movable relative to said internal surface from a position in which a compartment is defined in said interior between said one of said external walls and said internal surface having a compartment depth between said internal surface and said interior side for accommodating the object when said panel is in said retracted position, and a spacer secured on said interior side and being movable with said one of said external walls, said spacer being disposed in said compartment when said one of said external walls is in said position and having a spacer depth fixedly perpendicular to said external wall and corresponding to said compartment depth for abutment of said spacer with said internal surface to maintain said compartment depth when said one of said external walls is in said position, said spacer separating a pop-out portion of said compartment from the remainder of said compartment defined between said internal surface of unitary continuity and said one of said external walls.

2. The carrying case recited in claim 1 wherein said panel overlaps an exterior face of said one of said external walls to cover said window in said retracted position.

3. The carrying case recited in claim 1 wherein said panel fits at least partly within said window in said retracted position.

4. The carrying case recited in claim 1 wherein said panel is pivotally mounted to said one of said external walls for pivotal movement about a pivot line and said panel further includes a tab, opposite said pivot line, for being manually grasped to effect pivotal movement of said panel about said pivot line.

5. The carrying case recited in claim 1 and further including at least one fastener element releasably securing said panel to said one of said external walls in said retracted position.

6. The carrying case recited in claim 1 and further including at least one connecting member connecting said panel to said one of said external walls, said connecting member limiting pivotal movement of said panel in said extended position.

7. The carrying case recited in claim 1 wherein said enclosure has an opening into said interior and further including a zipper extending along said opening for selectively opening and selectively closing said opening.

8. The carrying case recited in claim 1 wherein said compartment is one of a plurality of compartments within said interior of said enclosure.

9. The carrying case recited in claim 1 wherein said enclosure is configured as a suitcase.

10. The carrying case recited in claim 1 a and further comprising a restraint on said interior face of said panel for securing the object on said panel.

11. The carrying case recited in claim 10 wherein said restraint comprises a pocket.

12. The carrying case recited in claim 11 wherein said pocket is a first pocket for receiving a first object and said restraint further comprises a second pocket for receiving a second object.

13. The carrying case recited in claim 10 wherein said restraint is adapted to hold a cellular phone.

14. The carrying case recited in claim 10 wherein said restraint is adapted to hold a PDA.

15. The carrying case recited in claim 1 wherein said spacer comprises a block member including one or more blocks.

16. The carrying case recited in claim 1 wherein said spacer circumscribes said window at least partially.

17. The carrying case recited in claim 1 wherein said spacer isolates the object from the said remainder of said compartment.

18. The carrying case recited in claim 1 wherein said one of said external walls is pivotal relative to said internal surface.

19. The carrying case recited in claim 1 wherein said enclosure includes a selectively openable, selectively closable opening into said compartment and said position corresponds to a closed position in which said opening is closed.

20. A carrying case comprising an enclosure comprising a plurality of external walls enclosing an interior, one of said external walls having a window therein in communication with said in interior and a panel pivotally mounted to said one of said external walls, said panel being pivotal relative to said one said external walls from a retracted position wherein said panel closes said window and an extended position wherein said panel is pivoted exteriorly outwardly away from said one of said external walls to open said window, said panel having an interior face for carrying an object disposed in said interior when said panel is in said retracted position and withdrawn from said interior when said panel is in said extended position said one of said external walls having an interior side and said enclosure having an internal surface spaced from said interior side, said one of said external walls being movable relative to said internal surface from a position in which a compartment is defined in said interior between said one of said external walls and said internal surface having a compartment depth between said internal surface and said interior side for accommodating the object when said panel is in said retracted position and a spacer secured on said interior side and being movable with said one of said external walls, said spacer being disposed in said compartment when said one of said external walls is in said position and having a spacer depth corresponding to said compartment depth for abutment of said spacer with said internal surface to maintain said compartment depth when said one of said external walls is in said position, and further comprising a restraint on said interior face of said panel for securing the object on said panel, said restraint comprising a cover movably mounted on said interior face of said panel, said cover being movable between a closed position in which said cover is disposed adjacent said interior face to enclose the object between said panel and said cover and an open position in which said cover is moved away from said panel to provide access to the object.

21. A carrying case comprising an enclosure comprising a plurality of external walls enclosing an interior, one of said external walls having a window therein in communication with said in interior and a panel pivotally mounted to said one of said external walls, said panel being pivotal relative to said one of said external walls from a retracted position wherein said panel closes said window and an extended position wherein said panel is pivoted exteriorly outwardly away from said one of said external walls to open said window, said panel having an interior face for carrying an object disposed in said interior when said panel is in said retracted position and withdrawn from said interior when said panel is in said extended position, said one of said external walls having an interior side and said enclosure having an internal surface spaced from said interior side, said one of said external walls being movable relative to said internal surface from a position in which a compartment is defined in said interior between said one of said external walls and said internal surface having a compartment depth between said internal surface and said interior side for accommodating the object when said panel is in said retracted position, and a spacer secured on said interior side and being movable with said one of said external walls, said spacer being disposed in said compartment when said one of said external walls is in said position and having a spacer depth corresponding to said compartment depth for abutment of said spacer with said internal surface to maintain said compartment depth when said one of said external walls is in said position, and further including a cover pivotally mounted on said interior face for movement between a closed position wherein said cover is disposed adjacent said interior face to enclose the object between said panel and said cover and an open position in which said cover is pivoted away from said interior face to provide access to the object.

22. The carrying case recited in claim 21 wherein said cover is rigid.

23. A carrying case comprising an enclosure comprising a plurality of external walls enclosing an interior, said enclosure being configured as a notebook, one of said external walls having a window therein in communication with said interior and a panel pivotally mounted to said one of said external walls, said panel being pivotal relative to said one of said external walls from a retracted position wherein said panel closes said window and an extended position wherein said panel is pivoted exteriorly outwardly away from said one of said external walls to open said window, said panel having an interior face for carrying an object disposed in said interior when said panel is in said retracted position and withdrawn from said interior when said panel is in said extended position, said one of said external walls having an interior side and said enclosure having a internal surface spaced from said interior side, said one of said external walls being movable relative to said internal surface from a position in which a compartment is defined in said interior between said one of said external walls and said internal surface having a compartment depth between said internal surface and said interior side for accommodating the object when said panel is in said retracted position, and a spacer secured on said interior side and being movable with said one of said external walls, said spacer being disposed in said compartment when said one of said external walls is in said position and having a spacer depth corresponding to said compartment depth for abutment of said spacer with said internal surface to maintain said compartment depth when said one of said external walls is in said position.

24. A carrying case comprising an enclosure comprising a plurality of external walls enclosing an interior, one of said external walls having a window therein in communication with said interior and a panel pivotally mounted to said one of said external walls, said panel being pivotal relative to said one of said external walls from a retracted position wherein said panel closes said window and an extended position wherein said panel is pivoted exteriorly outwardly away from said one of said external walls to open said window, said panel having an interior face for carrying an object disposed in said interior when said panel is in said retracted position and withdrawn from said interior when said panel is in said extended position, said one of said external walls having an interior side and said enclosure having an internal surface of unitary continuity spaced from and facing said interior side, said internal surface being coextensive with said interior side to define a compartment in said interior between said one of said external walls and said internal surface having a compartment depth between said internal surface and said interior side for accommodating the object when said panel is in said retracted position, and a spacer secured within said compartment, said spacer being unattached to said panel and having a spacer depth fixedly perpendicular to said external wall and corresponding to said compartment depth for abutment of said spacer with said internal surface and said interior side to maintain said compartment depth, said spacer separating a pop-out portion of said compartment from the remainder of said compartment defined between said internal surface of unitary continuity and said one of said external walls.

* * * * *